United States Patent [19]

Perez et al.

[11] 4,123,914

[45] Nov. 7, 1978

[54] ENERGY SAVING CHANGE OF PHASE REFRIGERATION SYSTEM

[75] Inventors: Arthur Perez; Edward E. Bowman, both of Niles, Mich.

[73] Assignee: Tyler Refrigeration Corporation, Niles, Mich.

[21] Appl. No.: 763,503

[22] Filed: Jan. 28, 1977

Related U.S. Application Data

[63] Continuation of Ser. No. 592,573, Jul. 2, 1975, abandoned.

[51] Int. Cl.[2] ..... F25B 41/00; F25B 27/02; F25B 39/02

[52] U.S. Cl. ..... 62/196 B; 62/238; 62/524

[58] Field of Search ..... 62/238, 151, 154, 196 R, 62/196 B, 524

[56] References Cited

U.S. PATENT DOCUMENTS

| | | | |
|---|---|---|---|
| 3,120,743 | 2/1964 | Wilson | 62/504 |
| 3,368,364 | 2/1968 | Norton et al. | 62/196 B |
| 3,427,819 | 12/1966 | Seghetti | 62/196 B |
| 3,529,432 | 9/1970 | Nussbaum | 62/196 B |
| 3,633,378 | 1/1972 | Toth | 62/196 B |
| 3,710,568 | 1/1973 | Mandlin | 62/403 |
| 3,926,008 | 12/1975 | Webber | 62/238 |

*Primary Examiner*—Lloyd L. King
*Attorney, Agent, or Firm*—LeBlanc & Shur

[57] ABSTRACT

An improved change of phase refrigeration system utilizing low compressor head pressures to maximize compressor efficiency, employing a relatively low temperature cooling medium to cool refrigerant gases, using a metering device which is operable at a relatively low pressure differential to feed condensate to the evaporator coil and providing additional controls to temporarily increase head pressure and thus condensate temperature when such increased temperature is needed for heat recovery or gas defrost. Because the proposed refrigeration system employs condensate at a relatively low temperature it may be necessary to enlarge the supply line for liquid refrigerant running from the condenser to the metering device to minimize evaporation of the condensate in the supply line. Further, it may be preferable to insulate the liquid refrigerant line so as to minimize premature evaporation of condensate in that line.

40 Claims, 2 Drawing Figures

ENERGY SAVING CHANGE OF PHASE REFRIGERATION SYSTEM

This is a continuation, of application Ser. No. 592,573 filed July 2, 1975, now abandoned.

BACKGROUND OF THE INVENTION

A conventional change of phase refrigeration system comprises a compressor for compressing relatively low pressure cool refrigerant gas into a relatively high pressure hot refrigerant gas, a condenser for cooling the hot refrigerant gas to a temperature below that at which it becomes a liquid while still remaining at the high pressure imposed at the output of the compressor, an expansion valve or metering device to control the flow of liquid refrigerant from the output of the condenser to an evaporator, the evaporator operating to refrigerate air circulating in the system by absorbing heat from air passing over the evaporator coils and thereby gasifying the liquid condensate contained therein. The evaporator gases are exhausted to a suction line which returns the gases to the compressor for recirculation through the system.

It is customary to operate systems of the type described above at conditions approximating summertime, whereby the discharge pressure of the compressor and, consequently, the condensing temperature of the condenser is relatively high. Thus, the compressor is run at a substantially high compression ratio.

However, the efficiency of the refrigeration system can vary substantially and it would be desirable to modify the components thereof to improve the efficiency of the system. For example, it is typical of compressors to increase in volumetric efficiency as the compression ratio of the discharge side of the compressor to the suction side of the compressor is reduced. With a compression ratio of 2-to-1 (discharge to suction), the efficiency of a refrigerating compressor is greatly increased (in the order of 90% or more). Further modifications to the refrigeration system would include a compressor which is cooled by the circulation of a relatively low temperature cooling medium, e.g., ambient air, therethrough to reduce the temperatures of the high pressure hot gases from the compressor to a temperature below that at which the gas becomes a liquid while remaining generally at the pressure imposed at the output of the compressor.

However, one factor militating against the use of compressors in a range producing lower discharge pressures and lower compression ratios, is the metering device commonly associated with a change of phase refrigeration system. Typically the metering device comprises a thermostatic expansion valve whose capacity responds to the difference between the pressure of the incoming condensate and the pressure of the outgoing gases from the evaporator. Typically these metering devices are adapted to function at relatively high condensing temperatures (conditions approximating summertime) because it is felt that there is a significant reduction in the ability of a metering device to pass sufficient refrigerant at lower condensing temperatures.

SUMMARY OF THE INVENTION

The present invention provides an improved change of phase refrigeration system. In the refrigeration system of the present invention the compressor is operated at a relatively low compression ratio, that is, the discharge pressure of the compressor is much lower than in typical refrigeration systems. With a lower discharge pressure the compression ratio is lower and the efficiency of the compressor is substantially higher. However, with the refrigerant gases entering the condensor at a relatively low discharge pressure, it becomes necessary to cool the gases to a lower temperature in order to liquify the gases at the discharge pressure of the compressor. In order to cool the gases it is desirable to circulate a low temperature cooling medium through the condenser to cool the refrigerant gases. For example, condenser units may be controlled so that ambient outside air may be used to reduce the temperature of the refrigerant to the lower condensing temperature necessitated by the modified system.

The difference between conventional refrigeration systems and the present system may be summarized as follows. Conventional systems employ condensate at a condition approximating summertime all year round. That is, the condensate temperature generally exceeds 110° F under most refrigerating conditions. The 110° F temperature for the condensate is based on the general rule that at least a 20° F differential in temperature normally exists between the condensate and the outside ambient temperature in order to keep the size of the components reasonable. The present system, however, may be modified to employ the 20° F temperature differential for condensate rather than high temperature condensate for increased efficiency. For example, in the winter, ambient outside air could be used in low temperature (−20° F or less) applications of the improved refrigeration system to lower the initial condensate temperature to 0° F or below. The system, of course, may be modified to employ other desired temperature differentials and/or ranges.

The improved refrigeration system also employs condensers capable of circulating low temperature cooling mediums, such as water or ambient air through the condenser. With the condensate at a substantially lower temperature than can be provided in standard change of phase refrigeration systems, a metering device must be provided which is operable at a relatively low pressure differential between the initial or entering pressure of the condensate into the evaporator and the final or outgoing pressure of the refrigerant gases leaving the evaporator for recirculation to the compressor. Accordingly, the improved refrigeration system provides for a metering device operable at relatively low pressure differentials.

Additionally, the improved refrigeration system includes means for temporarily increasing the discharge pressure of the compressor and thus the condensate temperature during those times when the system requires a higher condensate temperature, as during periods of heat recovery or gas defrost.

To maintain the condensate in the liquified state before it enters the evaporator, the improved refrigeration system includes precautionary means to preserve the liquification of the condensate, such as a somewhat larger liquid line from the condenser to the evaporator than indicated by customary practice or the insulation of the liquid line between the condenser and the evaporator to prevent the liquid refrigerant from vaporizing before it enters the evaporator.

It is an object of the present invention to provide an improved change of phase refrigeration system.

It is a further object of the present invention to provide an improved change of phase refrigeration system wherein the discharge pressure of the compressor is reduced, thereby reducing the compression ratio of the compressor and thus increasing the efficiency of the compressor; the condenser is capable of drawing a low temperature cooling medium, such as outside air into the entering side of the condenser to liquify the refrigerant gases at a relatively low temperature; metering means is operable at a relatively low pressure differential so as to provide sufficient condensate to the evaporator for proper operation of the evaporator at a relatively low condensate temperature; and means are provided for temporarily increasing the discharge pressure of the compressor, thereby increasing condensate temperature during periods of gas defrost or heat recovery for the system.

It is a further object of the present invention to provide a means for maintaining the refrigerant in a liquid state during the transfer of the condensate from the condenser to the evaporator.

Further objects and advantages of the present invention will become apparent to persons skilled in the art from the following description of a preferred embodiment accompanied by the attached drawings and will be pointed out in the claims.

DESCRIPTION OF THE PREFERRED EMBODIMENT

Figure 1:
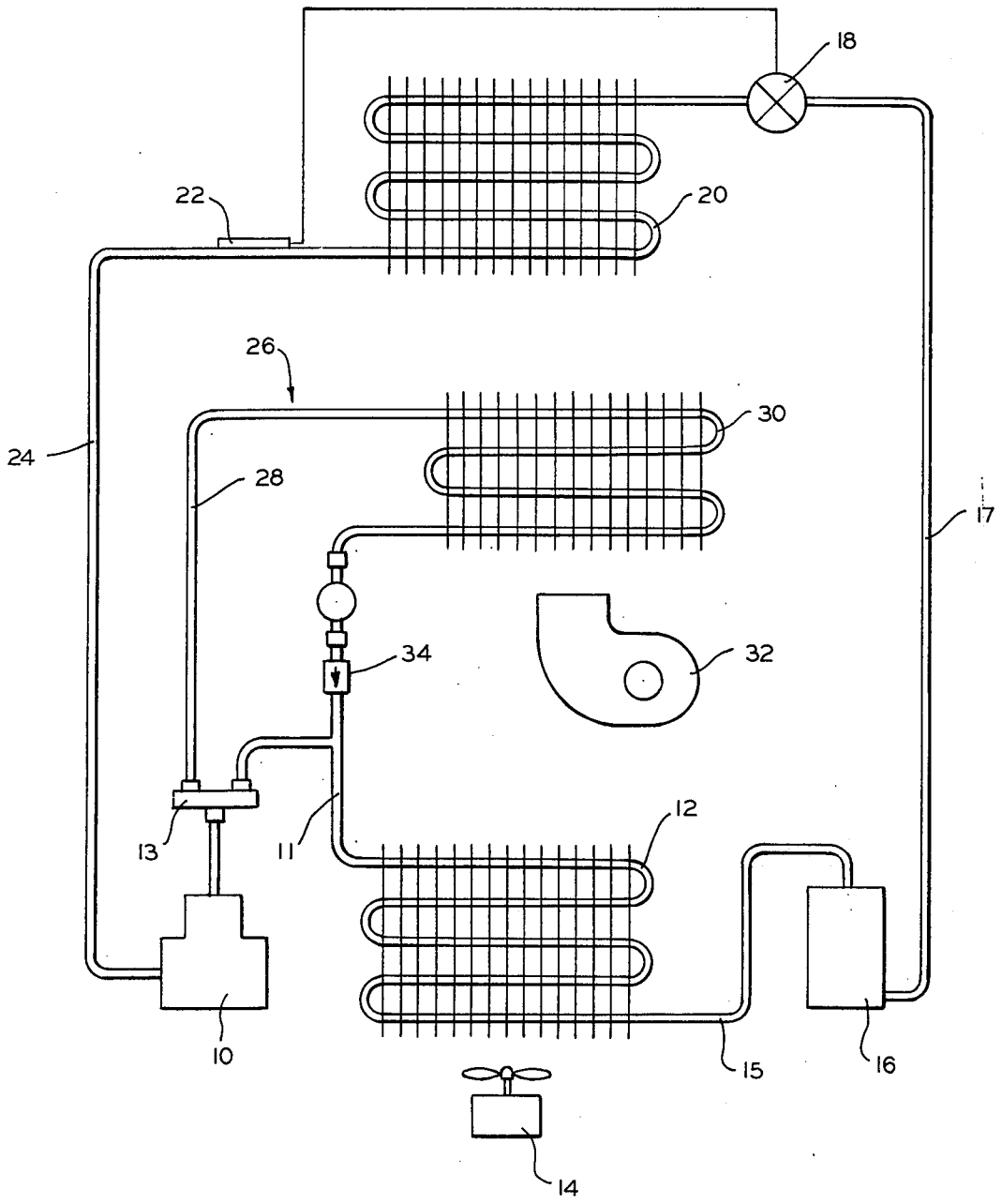
FIG. 1 is a schematic diagram of a preferred embodiment of the change of phase refrigeration system of the present invention.

Referring now to FIG. 1, the change of phase refrigeration system includes a refrigerant compressor 10 of the type normally used for compressing a common change of phase refrigerant such as Freon, $CO^2$, etc. The compressor 10 may be hermetic or non-hermetic and also may be of single or multi-cylinder construction.

The system also includes a refrigerant condenser 12 capable of condensing the refrigerant hot gas into a refrigerant liquid by cooling the hot gas below the temperature at which it becomes a liquid. In FIG. 1, a thermostatic controlled blower or fan 14 is provided for cooling its associated condenser 12. However, any cooling medium capable of achieving the cooling temperatures for the present system may be employed. The condenser 12 and the fan 14 are so adapted that outside air may pass into the entering side of the condenser to cool the refrigerant contained therein. 16 is a liquid receiver of the common type which collects the liquid refrigerant from its associated condenser 12. A supply line 11 is provided between the compressor 10 and the condenser 12 to carry refrigerant gases from the compressor 10 to the condenser 12. A two-position valve 13 is provided in the supply line 11 for a purpose to be described later. At the discharge side of the condenser 12 is provided a first liquid refrigerant supply line 15 running from the condenser 12 to the receiver 16. The receiver 16 is connected to an evaporator 20 by a second liquid refrigerant supply line 17 running from the receiver 16 to the evaporator 20. Also provided in the liquid supply line 17, between the receiver 16 and the evaporator 20, is a thermostatic expansion valve 18 which monitors the amount of liquid refrigerant entering the evaporator 20.

The evaporator 20 may take various forms and typically may comprise a coil through which the liquid refrigerant passes, with the trapped air of the refrigeration system being drawn across the coil in any known manner to cool the trapped refrigerated air of the system, the cooling of the air in the refrigerated system resulting in the gasification of the refrigerant. A sensor 22, responsive to the pressure of gases exiting the evaporator, is provided at an outlet of the evaporator 20 to regulate the amount of liquid refrigerant entering the evaporator 20. The sensor 22 is mounted at the front portion of a suction line 24 which carries the cool evaporant discharge gases to the compressor 10.

The two-position valve 13 is responsive to external conditions to direct the flow of compressor discharge gases to the condenser 12 or to a heat recovery section 26 associated with the refrigeration system of the present invention. Supply line 28 carries the compressor discharge gases from the valve 13 to a heat recovery coil 30. A heat recovery blower 32 is associated with the coil 30. A restricting means 34, such as a spring-loaded check valve, is provided between the exit port of the heat recovery coil 30 and the condenser 12.

Figure 2:
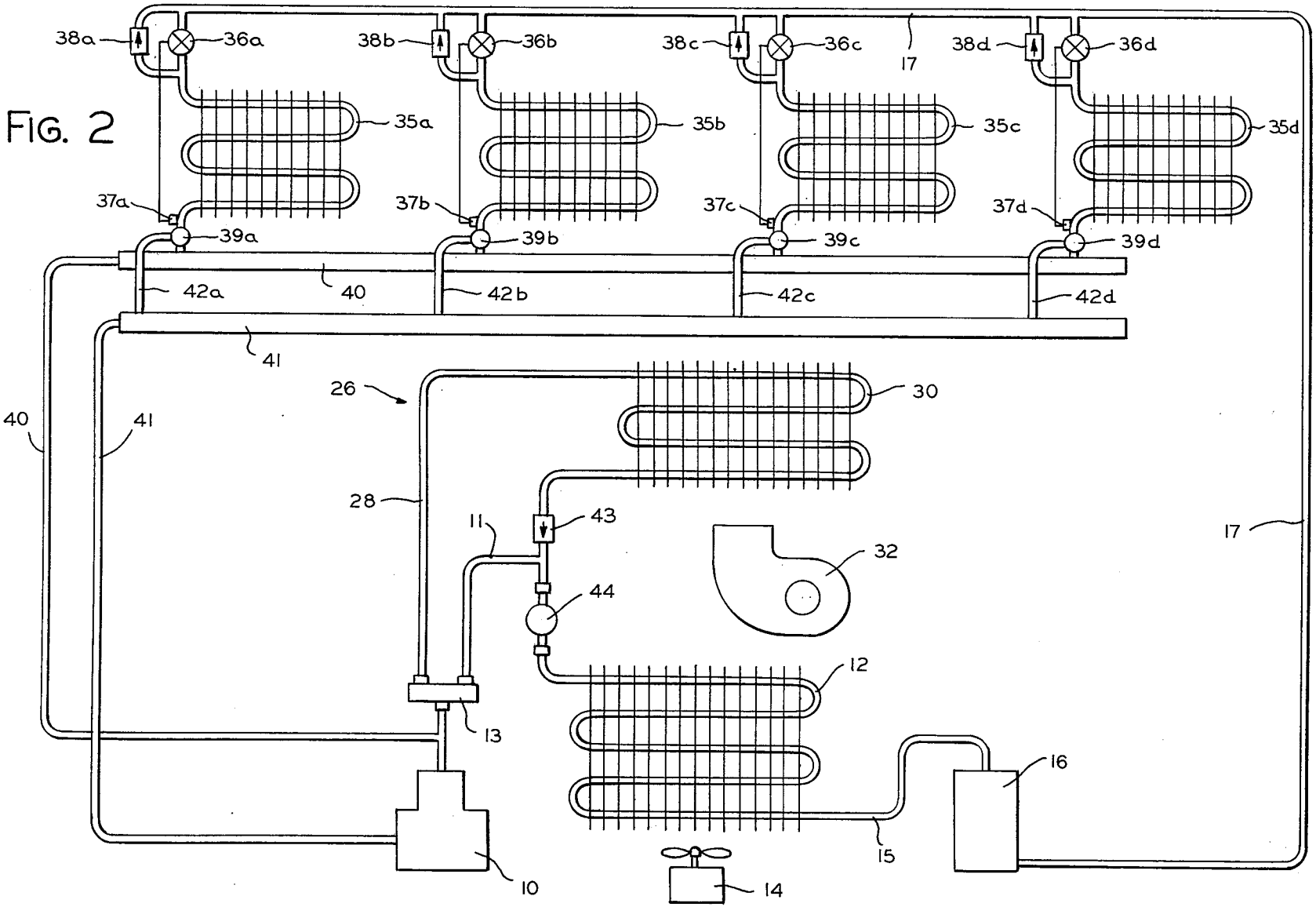
FIG. 2 is a schematic diagram of a second embodiment of the change of phase refrigeration system of the present invention.

Referring now to FIG. 2, a second embodiment of the present invention is disclosed wherein the evaporator is modified to include components permitting a gas defrost cycle in the operating cycle of the refrigeration system of the present invention. In FIG. 2, the refrigeration system includes a compressor 10, a supply line 11, a condenser 12, a two-position valve 13, a condenser fan 14, a liquid supply line 15, a receiver 16, and a liquid supply line 17. However, the system of FIG. 2 employs a plurality of evaporator coils 35, each coil 35 having a thermostatic expansion valve 36, its associated sensor 37, a check valve 38, and a two-position valve 39 associated therewith. The coils 35 and their respective components associated therewith are further identified in FIG. 2 by the appropriate suffix *a, b, c* or *d*.

One port of the valve 39 is connected to the discharge side of the evaporator coil 35. A compressor discharge gas supply line 40 extending from the discharge side of the compressor 10 is connected to a second port of the valve 39. A suction line 41 having branches 42 extending thereto from respective third ports of the valves 39 connect the evaporators 35 to the suction side of the compressor 10.

The heat recovery portion 26 of the system includes the supply line 28, the heat recovery coil 30 and the heat recovery fan 32. However, the restricting means 34 of FIG. 1 are replaced in FIG. 2 by restricting means 43 and 44, the means 43 comprising a check valve or similar device and the means 44 comprising a two-position valve or similar device.

OPERATION OF THE PREFERRED EMBODIMENTS

Referring now to the operation of the change of phase refrigeration system shown in FIG. 1, the compressor 10 compresses the low pressure cool refrigerant gas from the suction line 24 into a high pressure hot refrigerant gas and exhausts this gas through the valve 13 into the line 11 through which it is carried to the condenser 14. Here the hot gas is cooled to a temperature below that at which it becomes a liquid while still remaining at the high pressure imposed at the output of the compressor. It should be noted that in the improved system provided herein the discharge gas from the compressor is discharged at a pressure higher than that on the intake side but substantially lower than the discharge pressure required for the normal operation for a typical change of phase refrigerant system. With a lower discharge pressure for the refrigerant gas, the gas condenses at a relatively lower temperature. Typically, the system would be operated under conditions at which the refrigerant gas would condense at temperatures 20° F above the ambient temperature.

The rate at which the heat is removed from the refrigerant gas to cause the gas to change to a liquid varies with the temperature of the medium surrounding the coils and with the rate at which the medium is circulated across the coils. In the particular embodiment of the invention disclosed herein, the condenser coil 12 is located in the outside atmosphere whereby ambient outside air may be drawn across the coils to cool the refrigerant gas.

Because the ambient temperature of the air can vary considerably from day to night and extremely between the seasons, a thermostatically controlled fan 14 is utilized in order to control the heat transfer throughout these varying conditions. This fan 14 may be thermostatically controlled by ambient air temperature or by the temperature of the liquid refrigerant leaving the condenser through the line 15. Line 15 carries the liquid refrigerant to the receiver 16. The liquid refrigerant line 17 carries the refrigerant from the receiver to the evaporator 20. The thermostatically controlled valve 18 adjacent the inlet of the evaporator 20 controls the flow of liquid refrigerant into the evaporator.

The valve or metering device 18 is controlled thermostatically by an element 22 secured adjacent an outlet of the evaporator 20. If the pressure of the outlet gases of the evaporator decreases below a predetermined level, more refrigerant is introduced into the evaporator 20. The liquid refrigerant in the evaporator coils of the evaporator 20 draws heat from air circulating across the coils to vaporize the refrigerant. This refrigerant vapor or gas is then exhausted through an exit port into line 24 at relatively low temperature and pressure. The gas then returns to the compressor 10 through the line 24 to start the refrigeration cycle over again.

Heat recovery refers to the use of a refrigerating compressor to build up the pressure and consequently the temperature of compressor discharge gases so that the excess heat generated by such gases may be used for heating purposes in an integrated thermal system to reduce the demand on other components (furnaces, heaters, etc.) in the system. The heat recovery section 26 of the present invention is initiated by an external control (not shown) associated with the two-position valve 13. The heat recovery cycle of the refrigeration system is initiated when the first path through the valve 13 to the condenser 12 is closed and compressor discharge gases flow through the supply line 28 to the heat recovery coil 30. Restrictive means 34, such as a spring loaded check valve, blocks the flow of compressor discharge gases out of the heat recovery section 26 of the refrigeration system until the pressure and the temperature of the discharge gases have built to a predetermined level. Means are provided with the heat recovery section of the refrigeration system to carry off excess heat generated in the heat recovery coil 32 for use in an integrated thermal system. Such means may include, but are not restricted to, the heat recovery blower 32. When the pressure in the heat recovery section 26 has built to a predetermined level the restrictive means 34 is opened to release the compressor discharge gases to the condenser 12.

In certain refrigeration systems it may be desirable to use hot compressor gases to defrost the evaporator coil. Gas defrost involves the so-called "reverse flow" of hot compressor discharge gases through the evaporator coil. Unless means are provided to port these hot gases back to the compressor, the efficiency of the system is severely degraded. Consequently, it has become customary in the trade to employ gas defrost with no less than four evaporator coils, so that no more than 25% of the cooling capacity of the refrigeration system is affected during periods of gas defrost.

Referring now to FIG. 2, during periods of gas defrost the valve 13 would be opened to permit flow from the compressor into the supply line 11. However, the restricting means 44 would be closed to block flow from the supply line 11 to the condenser 12 and the restricting means 43 would block "reverse" flow to the heat recovery coil 30. After the discharge pressure of the compressor had reached the desired higher level, for example, valve **39*a* would be open to permit flow of the compressor discharge gases through the supply line 40 into the evaporator operator coil 35*a*. The natural flow of the discharge gases would be from a region of higher temperature to a region of relatively low temperature. Thus, gas would flow from the discharge side of the compressor 10 through the supply line 40 through the valve 39*a* and into the coil 35*a*. The defrost gases would be exhausted out of the coil 35*a* through the check valve 38*a* to be mixed with condensate from the supply line 17 and carried into the remaining evaporator coils 35 through the thermostatic expansion valves 36 to pass through the remaining coils 35 and return to the compressor 10 through the suction line 41**.

It is easily seen that the system of FIG. 2 may be used for heat recovery purposes with the shifting of the valve 39 to permit suction from the evaporator coils 35, the shifting of the two-position valve 13 to the position blocking flow of compressor discharge gases to the supply line 11 and permitting flow of discharge gases to the supply line 28 into the heat recovery section 26, and the opening of means 44 to permit gas flow to the condensor 12 of the refrigeration system shown in FIG. 2.

It should also be apparent to one skilled in the art that the heat recovery section and the gas defrost section of the refrigeration system shown in FIG. 2 could operate independently of one another so that the heat recovery section 26 could be eliminated and the gas defrost section could be retained.

Because of the relatively low pressure of gases entering the condenser 12, it becomes necessary to cool the gases in the condenser 12 to a relatively lower temperature in order to achieve liquification of the refrigerant gases. Further, it becomes necessary to provide sufficient means to transfer the relatively low temperature condensate of the condenser 12 to the evaporator in the liquid stage. This is achieved by enlarging the liquid refrigerant supply line 17 between the condenser and the evaporator or appropriately insulating the liquid refrigerant supply line 17.

The present invention provides for an improved change of phase refrigeration system wherein the compressor is operated at relatively low compression ratio with resultant high efficiency. The condenser is cooled by a low temperature medium to condense the refrigerant gases at a relatively low condensate temperature and the metering device between the condenser and the evaporator is operable at a relatively low pressure differential. The present system also includes a means for temporarily increasing the discharge pressure of the compressor to provide relatively high pressure compressor gases for use during a heat recovery cycle or a gas defrost cycle of the refrigeration system.

Having thus described the preferred embodiment of the present invention, it will be, of course, understood that various changes can be made in form, details, arrangements and proportions of the parts without departing from the scope of the invention which consists of the matter shown and described herein and set forth in the appended claims.

I claim:

1. An improved change of phase refrigeration system having a closed refrigeration circuit, comprising: a compressor; a condenser; a liquid refrigerant receiver; evaporating means; hot gas supply conduit means coupled between the discharge side of the compressor and the condenser; first liquid refrigerant supply conduit means coupled between the condenser and the receiver; second liquid refrigerant supply conduit means coupled between the receiver and the evaporating means; third conduit means coupled between the evaporating means and compressor to complete a circulation circuit for movement of refrigerant through the refrigeration system; metering means interposed in said second liquid refrigerant supply conduit means for controlling the flow of refrigerant to the evaporating means in accordance with the requirements of the evaporating means; sensor means controlling said metering means responsive to the condition of refrigerant in said conduit means; valve means interposed between said evaporating means and said compressor for selectively directing refrigerant flow in a forward direction from said evaporating means to the suction side of the compressor or in a reverse direction from the discharge side of the compressor through said evaporating means during refrigeration and defrost cycles, respectively; restricting means interposed in said closed circuit between the compressor and receiver for controlling the discharge pressure of the compressor, said restricting means being selectively actuable to increase the discharge pressure of the compressor to thereby increase the condensate temperature of the refrigerant at the discharge side of the compressor, said restricting means being actuable during the defrost cycle to restrict the flow of refrigerant at the discharge side of the compressor to thereby increase the temperature of refrigerant at the discharge side of the compressor relative to the refrigerant temperature during a normal refrigeration cycle; a heat recovery coil provided between the compressor and the condensor; means for carrying away the heat generated by the heat recovery coils; and controlled valve means for selectively directing compressor discharge refrigerant to the condenser or to the heat recovery coil; and wherein said restricting means may be controlled to restrict the flow of the compressor discharge refrigerant from the heat recovery coil until the pressure of the discharge refrigerant reaches a desired higher pressure level.

2. A refrigeration system according to claim 1, further comprising: second restricting means located on the discharge side of said heat recovery coil and releasable at a predetermined pressure level to permit the flow of high pressure compressor discharge refrigerant from the heat recovery coil to the condenser.

3. A refrigeration system according to claim 2, wherein said second restricting means comprising a spring loaded check valve.

4. A refrigeration system according to claim 1, wherein said controlled valve means comprises a two position valve for selectively directing the flow of compressor discharge refrigerant either to the heat recovery coil or to the condenser.

5. A refrigeration system according to claim 1, wherein said restricting means comprises a two position valve.

6. A refrigeration system according to claim 1, further comprising: valve means interposed between said evaporating means and said third conduit means; wherein said third conduit means comprises a suction conduit coupled between a first port of said valve means and the suction side of the compressor and an evaporator supply conduit coupled between the discharge side of the compressor and a second port of the valve means, a third port of the valve means being coupled to the discharge side of the evaporating means; said valve means being actuable to selectively couple the discharge side of the evaporating means to one of said suction and evaporator supply conduits during refrigeration and defrost cycles, respectively; wherein said valve means is actuable during the defrost cycle to direct a flow of refrigerant from the discharge side of the compressor, through said evaporator supply conduit, through said evaporating means and through said suction conduit to the suction side of the compressor.

7. A refrigeration system according to claim 6, wherein the evaporating means comprises a plurality of coils connected in parallel; the metering means comprises a plurality of metering devices associated with their respective coils, each metering device having a by-pass means associated therewith; and the valve means comprises a plurality of two position valves each interposed between the discharge side of its respective evaporator coil and the compressor, each valve permitting reverse flow of refrigerant from the discharge side of the compressor through its associated evaporator coil in one direction and forward flow of refrigerant through its evaporator coil into the suction side of the compressor in a second direction.

8. A refrigeration system according to claim 7, wherein during a defrost cycle at least one of said two position valves is maintained in a position to permit forward flow of refrigerant through its associated evaporator coil and at least one other of said two position valves is disposed to permit reverse flow of refrigerant through its associated evaporator coil.

9. An improved change of phase refrigeration system for operation with a change of phase refrigerant, comprising: a compressor; a condenser adapted to be cooled by a cooling medium; a receiver; an evaporator; high pressure hot gas supply line running from the compressor to the condenser; first liquid refrigerant supply line between the condenser and the receiver; second liquid refrigerant supply line between the receiver and the evaporator; metering means in the second liquid refrigerant supply line for controlling the flow of refrigerant to the evaporator in accordance with the requirements of the evaporator; suction line running from the evaporator to the compressor completing a circulation circuit for the refrigeration system; restricting means provided between the discharge side of the compressor and the condenser, said restricting means including first restricting means for controlling the direction of flow of the discharge gases from the compressor, and second restricting means for blocking the flow of compressor discharge gases to the condenser, with the compressor being operated with the compression ratio of the discharge side to the suction side of the compressor being relatively low, and discharge gas from the compressor being cooled to a relatively low condensate temperature; said metering means operating at a relatively low pressure differential, with the metering means providing sufficient condensate to said evaporator at a relatively low condensate temperature; the restricting means being actuable to increase the discharge pressure of the compressor thus increasing the condensate temperature of the refrigerant circulating through the system; third restricting means provided between the discharge side of the evaporator and the compressor, such restricting means being actuable on initiation of a defrost cycle to increase the discharge pressure of the compressor, thereby increasing the condensate temperature of the refrigerant circulating through the system.

10. An improved change of phase refrigeration system as claimed in claim 9 wherein the first restricting means is connected in series with the second restricting means between the compressor and the condenser, the first restricting means directing the flow of compressor discharge gases to alternate paths, and the second restricting means either permitting or restricting flow of compressor discharge gases therethrough.

11. An improved change of phase refrigeration system as claimed in claim 10 wherein the first restricting means comprises a two-position valve.

12. An improved change of phase refrigeration system as claimed in 10 wherein the second restricting means comprises a two-position valve.

13. An improved change of phase refrigeration system as claimed in claim 10 wherein the third restricting means comprises: a two-position valve having a first port connected to the dicharge side of the evaporator, with a second port connected to the discharge side of the compressor, and with a third port connected to the suction side of the compressor, the valve permitting reverse flow of hot refrigerant gases from the discharge side of the compressor through the evaporator coil in one direction and forward flow of cool evaporator gases through the evaporator coil into the suction side of the compressor of the refrigeration system in a second direction.

14. An improved change of phase refrigeration system as claimed in claim 10 wherein the evaporator comprises a plurality of coils connected in parallel, the metering means comprises a plurality of metering devices associated with their respective coils, each metering device having a by-pass means associated therewith, and the third restricting means comprises a plurality of two-position valves each mounted between the discharge side of its respective evaporator coil and the compressor of the refrigeration system, the valve permitting reverse flow of hot refrigerant gases from the discharge side of the compressor through its associated evaporator coil in one direction and forward flow of cool evaporator gases through its evaporator coil into the suction side of the compressor of the refrigeration system in a second direction.

15. An improved change of phase refrigeration system as claimed in claim 10 wherein the system comprises heat recovery means including a heat recovery coil provided between the compressor and the condenser, and means for carrying away the heat generated by the heat recovery coil whereby the first restricting means may be selectively controlled to direct compressor discharge refrigerant gases to the condenser or to the heat recovery coil, and said second restricting means may be controlled to block the flow of the compressor discharge gases from the heat recovery coil until the pressure of the discharge gases reaches the higher pressure levels desired.

16. A change of phase refrigeration system for operation with a change of phase refrigerant, comprising: a compressor; a condenser, and means for cooling said condenser by a cooling medium; a receiver; an evaporator; hot gas supply line running from the compressor to the condenser; first liquid refrigerant supply line between the condenser and the receiver; second liquid refrigerant supply line between the receiver and the evaporator; metering means in the second liquid refrigerant supply line for controlling flow of refrigerant to the evaporator in accordance with the requirements of the evaporator; conduit means for movement of refrigerant from the evaporator to the compressor completing a circulation circuit for the refrigeration system; sensor means controlling said metering means responsive to condition of refrigerant in said conduit means; restricting means provided between the discharge side of the compressor and the condenser, said restrictive means including means for controlling flow of the discharge gases from the compressor to the condenser and blocking flow of compressor discharge gases to the condenser, with the compressor being operated with the compression ratio of the discharge side of the suction side of the compressor being relatively low and discharge gas from the compressor being cooled to a relatively low condensate temperature; said metering means operating at a relatively low pressure differential and the metering means providing sufficient condensate to the evaporator at a relatively low condensate temperature; said restricting means being actuable to increase the discharge pressure of the compressor thus increasing the condensate temperature of the refrigerant circulating through the system; the system further comprising heat recovery means including a heat recovery coil provided between the compressor and the condenser, and means for carrying away the heat generated by the heat recovery coil; and wherein said first restricting means is selectively controllable to direct compressor discharge refrigerant gases to either of the condenser and the heat recovery coil, and said restricting means is also controllable to block the flow of the compressor discharge gases from the heat recovery coil to the condenser until the pressure of the discharge gases reaches higher predetermined pressure levels.

17. A system as claimed in claim 16 wherein said restricting means comprises two-position valve means for directing the flow of compressor discharge gases either to the heat recovery means of the refrigeration system or to the condenser of the refrigeration system.

18. A system as claimed in claim 17 wherein said restricting means also comprises a spring-loaded check valve releasable at a predetermined pressure level to permit the flow of high pressure compressor discharge gases from said heat recovery coil to the condenser.

19. A system as claimed in claim 16 wherein the means for carrying away the heat generated by the heat recovery coil includes a heat recovery blower.

20. A system as claimed in claim 16 wherein the liquid refrigerant supply line running from the condenser to the evaporator is insulated to maintain the condensate in liquid form.

21. A system as claimed in claim 16 wherein the liquid refrigerant supply line running from the condenser to the evaporator is enlarged to maintain the condensate in liquid form.

22. A system as claimed in claim 16 wherein third restricting means are provided between the discharge side of the evaporator and the compressor, the restricting means being actuable on initiation of a defrost cycle to increase the discharge pressure of the compressor thus increasing the condensate temperature of the refrigerant circulating through the system.

23. A system as claimed in claim 22 wherein said restricting means includes first and second restricting means, with the first restricting means being connected in series with the second restricting means between the compressor and the condenser so that the first restricting means may direct flow of compressor discharge gases to alternate paths and the second restricting means may either permit or restrict flow of compressor discharge gases therethrough.

24. A system as claimed in claim 23 wherein the first restricting means comprises a two-position valve.

25. An improved change of phase refrigeration system as claimed in claim 23 wherein the second restricting means comprises a two-position valve.

26. A system as claimed in claim 23 wherein the third restricting means comprises a two-position valve having a first port connected to the discharge side of the evaporator, with a second port connected to the discharge side of the compressor, and with a third port connected to the suction side of the compressor, the valve permitting reverse flow of hot refrigerant gases from the discharge side of the compressor through the evaporator coil in one direction and forward flow of cool evaporator gases through the evaporator coil into the suction side of the compressor of the refrigeration system in a second direction.

27. A system as claimed in claim 23 wherein the evaporator comprises a plurality of coils connected in parallel, the metering means comprises a plurality of metering devices associated with their respective coils, each metering device having a by-pass means associated therewith, and the third restricting means comprises a plurality of two-position valves each mounted between the discharge side of its respective evaporator coil and the compressor of the refrigeration system, the valve permitting reverse flow of hot refrigerant gases from the discharge side of the compressor through its associated evaporator coil in one direction and forward flow of cool evaporator gases through its evaporator coil into the suction side of the compressor of the refrigeration system in a second direction.

28. In a closed circuit change of phase refrigeration system having a normal change of phase refrigeration cycle and at least one other change of phase cycle, comprising compressor means having a discharge side and a suction side, condensing means coupled to the discharge side of the compressor means, receiver means coupled to the condenser means, evaporator means, liquid refrigerant supply conduit means coupled between the receiver means and the evaporator means, metering means interposed in said liquid refrigerant supply conduit means for controlling the flow of refrigerant to the evaporator means in accordance with the requirement of the evaporating means, and further conduit means coupling the evaporator means to the suction side of the compressor means to complete a closed refrigeration circulation circuit; the improvement comprising;

restricting means interposed in said closed circuit between the compressor discharge and the receiver, said restricting means being selectively actuable to maintain a first refrigerant pressure at the compressor discharge during the refrigeration cycle and a second, substantially different pressure at the compressor discharge during said at least one other change of phase cycle; and valve means interposed between said evaporating means and said further conduit means, wherein said further conduit means comprises a suction conduit coupled between a first port of said valve means and the suction side of the compressor and an evaporator supply conduit coupled between the discharge side of the compressor and a second port of the valve means, a third port of the valve means being coupled to the evaporating means;

wherein:

said at least one other change of phase cycle comprises a defrost cycle; and said restricting means is actuable during the defrost cycle to restrict the flow of refrigerant at the discharge side of the compressor to thereby increase the temperature of refrigerant at the discharge side of the compressor relative to the refrigerant temperature during a normal refrigeration cycle;

said valve means being actuable to selectively couple the evaporating means to one of said suction and evaporator supply conduits during refrigeration and defrost cycles.

29. A refrigeration system according to claim 28, further comprising: a heat recovery coil provided between the compressor and the condenser; means for carrying away the heat generated by the heat recovery coil; and controlled valve means for selectively inserting said heat recovery coil into said closed refrigeration circuit; wherein:

said at least one other change of phase cycle comprises a heat recovery cycle; and said restricting means may be controlled to restrict the flow of the compressor discharge refrigerant when the heat recovery coil is inserted into the closed refrigeration circuit during the heat recovery cycle until the pressure of the discharge refrigerant reaches a desired higher pressure level than the refrigerant pressure during the normal refrigeration cycle.

30. A refrigeration system according to claim 29, further comprising: second restricting means located on the discharge side of said heat recovery coil and releasable at a predetermined pressure level to permit the flow of high pressure compressor discharge refrigerant from the heat recovery coil to the condenser.

31. A refrigeration system according to claim 30, wherein said second restricting means comprises a spring loaded check valve.

32. A refrigeration system according to claim 29, wherein said controlled valve means comprises a two position valve for selectively directing the flow of compressor discharge refrigerant either to the heat recovery coil or to the condenser.

33. A refrigeration system according to claim 28, wherein said restricting means is located between the compressor discharge and the condenser means.

34. A refrigeration system according to claim 33 wherein said restricting means comprises a two position valve.

35. In a closed circuit change of phase refrigeration system having a normal change of phase refrigeration cycle and at least one other change of phase cycle, comprising compressor means having a discharge side and a suction side, condensing means coupled to the discharge side of the compressor means, receiver means coupled to the condenser means, evaporator means, liquid refrigerant supply conduit means coupled between the receiver means and the evaporator means, metering means interposed in said liquid refrigerant supply conduit means for controlling the flow of refrigerant to the evaporator means in accordance with the requirement of the evaporating means, and further conduit means coupling the evaporator means to the suction side of the compressor means to complete a closed refrigeration circulation circuit; the improvement comprising:

restricting means interposed in said closed circuit between the compressor discharge and the receiver, said restricting means being selectively actuable to maintain a first refrigerant pressure at the compressor discharge during the refrigeration cycle and a second, substantially different pressure at the compressor discharge during said at least one other change of phase cycle; and a heat recovery coil provided between the compressor and the condenser;

means for carrying away the heat generated by the heat recovery coil; and controlled valve means for selectively inserting said heat recovery coil into said closed refrigeration circuit;

wherein:

said at least one other change of phase cycle comprises a heat recovery cycle; and said restricting means may be controlled to restrict the flow of the compressor discharge refrigerant when the heat recovery coil is inserted into the closed refrigeration circuit during the heat recovery cycle until the pressure of the discharge refrigerant reaches a desired higher pressure level than the refrigerant pressure during the normal refrigeration cycle.

36. A refrigeration system according to claim 35, further comprising: second restricting means located on the discharge side of said heat recovery coil and releasable at a predetermined pressure level to permit the flow of high pressure compressor discharge refrigerant from the heat recovery coil to the condenser.

37. A refrigeration system according to claim 36, wherein said second restricting means comprises a spring loaded check valve.

38. A refrigeration system according to claim 35, wherein said controlled valve means comprises a two position valve for selectively directing the flow of compressor discharge refrigerant either to the heat recovery coil or to the condenser.

39. A refrigeration system according to claim 35, wherein said restricting means is located between the compressor discharge and the condenser means.

40. A refrigeration system according to claim 39, wherein said restricting means comprises a two position valve.

* * * * *